US005620114A

United States Patent [19]

Chalfa, Jr.

[11] Patent Number: 5,620,114

[45] Date of Patent: Apr. 15, 1997

[54] SLIDING VALVE FOR SINGLE HANDED FLUID DISPENSING

[76] Inventor: Bobby L. Chalfa, Jr., 5261 Central Ave., Bonita, Calif. 91902

[21] Appl. No.: 594,898

[22] Filed: Jan. 31, 1996

[51] Int. Cl.[6] ..... B67D 5/06

[52] U.S. Cl. ..... 222/23; 222/561

[58] Field of Search ..... 222/23, 545, 559, 222/561

[56] References Cited

U.S. PATENT DOCUMENTS

| | | | |
|---|---|---|---|
| 2,537,545 | 1/1951 | Patterson . | |
| 2,625,302 | 1/1953 | Mahoney | 222/561 X |
| 2,653,736 | 9/1953 | Jamieson | 222/561 X |
| 2,666,555 | 1/1954 | Hill | 222/561 X |
| 3,118,577 | 1/1964 | Estabrook | 222/561 X |
| 3,222,037 | 12/1965 | Thiel et al. | 222/561 X |
| 3,643,704 | 2/1972 | Carr | 222/561 X |
| 3,696,977 | 10/1972 | Davenpory et al. | 222/561 |
| 3,731,855 | 5/1973 | Vos | 222/561 X |
| 3,757,981 | 9/1973 | Harris, Sr. et al. | 222/545 X |
| 4,015,602 | 4/1977 | Nelson et al. | 222/561 X |
| 4,274,562 | 6/1981 | Medeiros et al. | 222/401 |
| 4,382,529 | 5/1983 | Drdlik | 222/545 X |
| 4,441,638 | 4/1984 | Shimano . | |
| 4,541,551 | 9/1985 | Vierkotter et al. | 222/561 X |
| 4,807,786 | 2/1989 | Gueret | 222/545 X |
| 5,145,094 | 9/1992 | Perlmutter | 222/545 X |
| 5,289,945 | 3/1994 | Stradder | 222/561 X |
| 5,295,597 | 3/1994 | Green . | |
| 5,358,132 | 10/1994 | Bennett | 222/561 X |
| 5,425,483 | 6/1995 | Mertes | 222/561 |
| 5,458,274 | 10/1995 | Maietta | 222/39 |

FOREIGN PATENT DOCUMENTS

| | | |
|---|---|---|
| 1227748 | 8/1960 | France . |
| 2565560 | 12/1985 | France . |
| 245950 | 8/1947 | Switzerland . |
| 1428806 | 3/1976 | United Kingdom . |

*Primary Examiner*—Kevin P. Shaver
*Attorney, Agent, or Firm*—Richard C. Litman

[57] ABSTRACT

A fluid container, for particular use, for example, as a water dispensing bottle carried on the frame of a bicycle, having a valve system incorporated in the cap for provides single handed operation. The valve system includes a sliding member that opens the valve system when pushed to either extreme position. The sliding member also provides an indirect tactile indication that the valve has reached a central or closed position. The sliding member of the valve system, along with the tactile indications provide a single handed device that does not impede the attention of the bicyclist.

4 Claims, 4 Drawing Sheets

SLIDING VALVE FOR SINGLE HANDED FLUID DISPENSING

BACKGROUND OF THE INVENTION

1. Field of the Invention

The present invention relates to a fluid dispensing container and a cap having a valve system particularly useful for single handed operation. Such containers are commonly used for dispensing refreshing liquids, such as water, soft drinks, electrolytes, etc., to participants of high impact physical activities. Specifically, bicyclists, marathon runners, aerobic exercisers, etc. need a easily dispensed form of refreshment.

2. Description of the Prior Art

Many types of fluid dispensing containers and valve systems are known; however, these devices tend to require more than a single handed operation. For example, U.S. Pat. No. 5,145,094, issued to Perlmutter, and U.S. Pat. No. 4,441,638, issued to Shimano, each discloses a conventional pull top type closure for a squeeze bottle. Such type closures are easily opened, however, for a racing bicyclist; one handed operation is accompanied by the use of the teeth to pull the pulltop open. Such activity is detrimental to the teeth, and even more problematic for teeth having braces thereon. Also, U.S. Pat. No. 2,537,545, issued to Patterson; U.S. Pat. No. 4,382,529, issued to Drdlik; U.S. Pat. No. 4,807,786, issued to Gueret; U.S. Pat. No. 5,295,597, issued to Green; French Patent Documents 1,227,748, and 2,565,560; and Gt. Britain Patent Document 1,428,806, all disclose a fluid dispensing containers. In addition, U.S. Pat. No. 3,757,981, Harris, Sr. et al., U.S. Pat. No. 4,274,562, issued to Mederios et al., and Switzerland Patent Document No. 245,950, each disclose a sliding type valve for delivery of fluids from a container. None of these containers however, satisfy the problem of single handed operation, particularly during activities requiring heavy physical exertion and control, such as marathon running or bicycle racing competition.

None of the above inventions and patents, taken either singly or in combination, is seen to describe the instant invention as claimed.

SUMMARY OF THE INVENTION

Accordingly, it is a principal object of the invention to provide a fluid container for single handed dispensing of fluid contents.

It is another object of the invention to provide a valve system in the cap of a fluid container for facilitating quick and easy one hand operation, including indirect tactile sensing of valve closure.

It is a further object of the invention to provide a replaceable cap for fluid containers.

Still another object of the invention is to provide a symmetrical valve porting arrangement for bi-directional opening of the valve.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
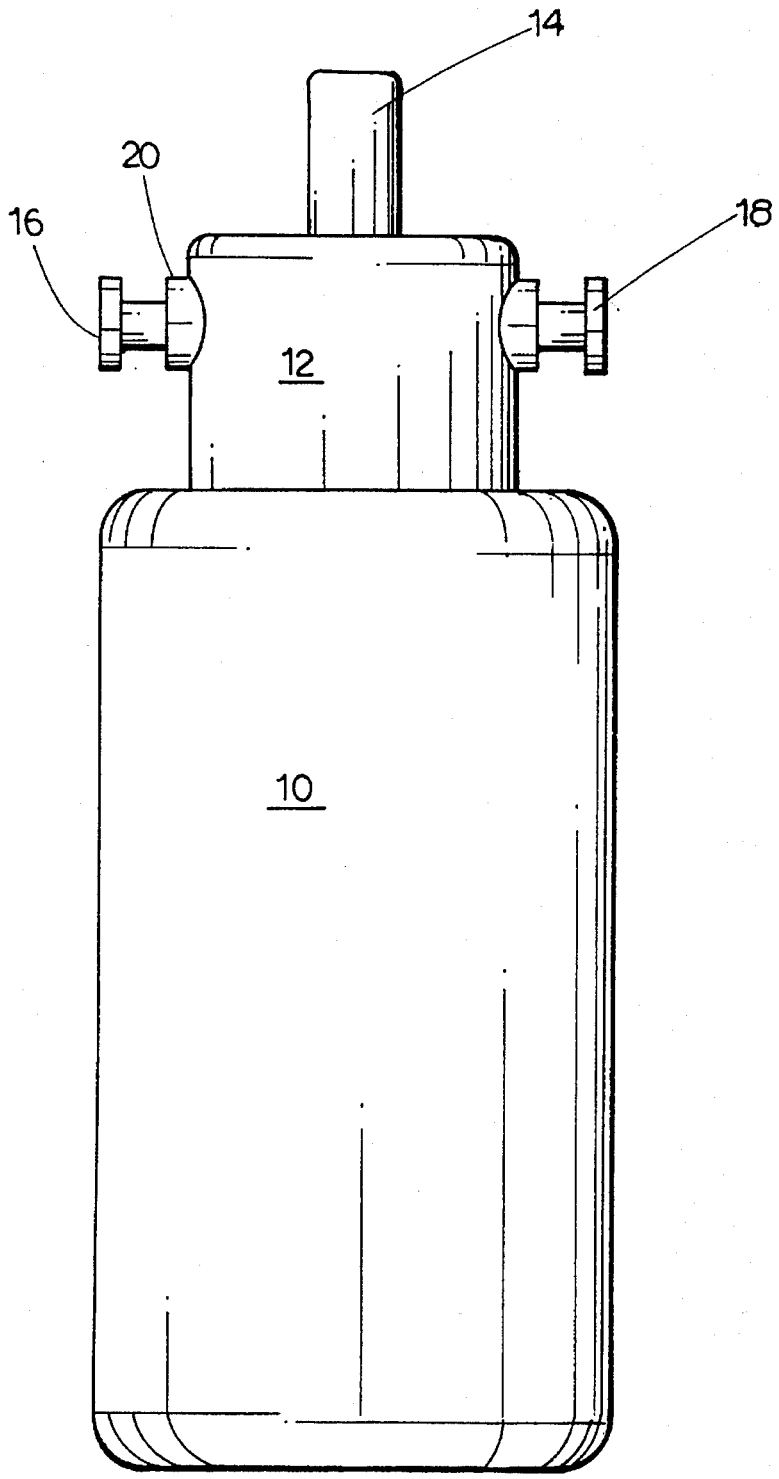
FIG. 1 is a front elevational view of the invention.

As can be seen by FIG. 1, the fluid container, generally referred to as 10, is, for example, typically a squeeze bottle for containing fluids such as water. The top of bottle 10 has a cap 12. The cap 12 has a spout 14 extending from the cap 12 for directing the flow of fluid expelled from the bottle 10. To facilitate the dispensing of the fluid, the cap 12 supports a valve system. The valve system provides a single handed operation for dispensing the fluid contained in the bottle 10. The single handed operation allows the bottle to be used in extremely heavy exertion activities where a person only has one hand available. For example, in bicycle competitions (where a participant is competing against not only other competitors but also time), it is important to maintain control of the bicycle. If the bicyclist needs to refresh himself while riding, it is old and well known to carry liquid refreshment on the bicycle. It is problematic however, to try to drink and maintain control when both hands are needed to open a water bottle. Also, it is difficult to use the conventional pull top type closures when engaging in a time dependent competition. In addition, the pull top type closures are not conducive to racing because teeth or braces may be damaged by the shock or impact of pulling the top open in order to drink the contents of the bottle.

For single handed operation, the valve system of the present invention uses an indirect tactile sensation for indicating the opening and closing of the container. The valve system has a sliding member 16 that extends through a channel in cap 12. The sliding member 16 has radially protruding flanges 18 on each end. The cap 12 has stops 20 limiting the extent of travel of the sliding member 16 by engaging the flanges 18.

Figure 2:
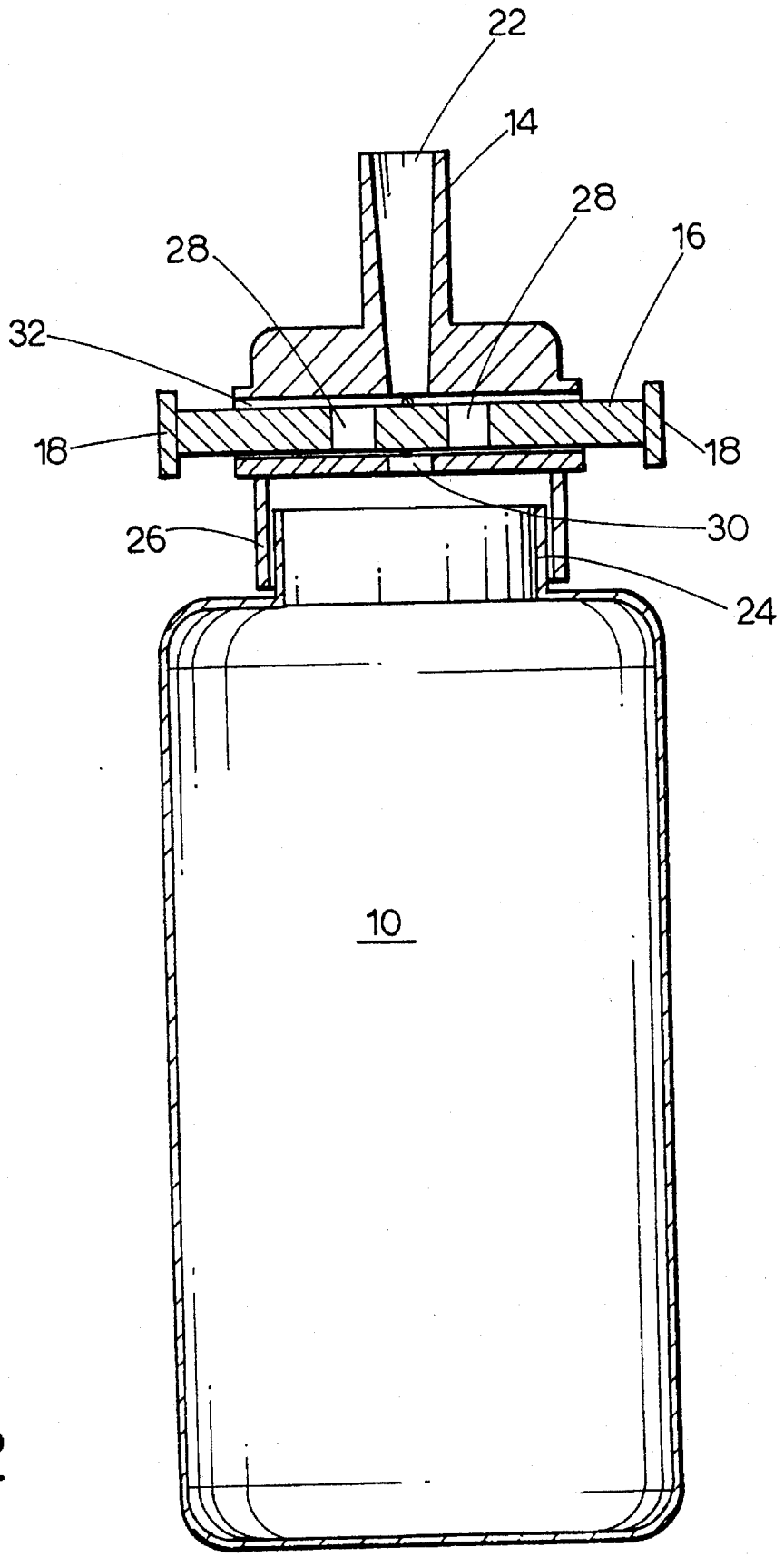
FIG. 2 is a vertical cross sectional view of the invention as shown in FIG. 1.
Figure 3:
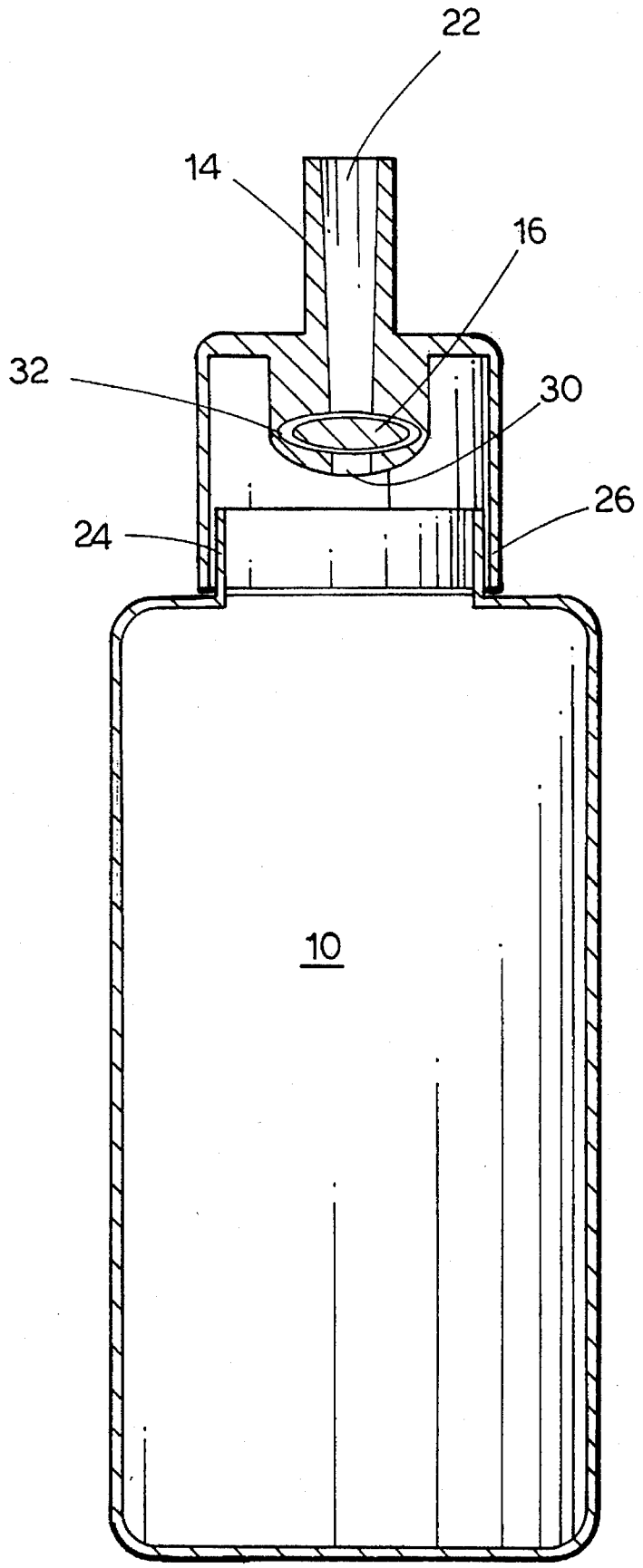
FIG. 3 is another vertical cross sectional view of the invention as shown in FIG. 1, the section plane being offset 90 degrees from the view seen in FIG. 2.
Figure 4:
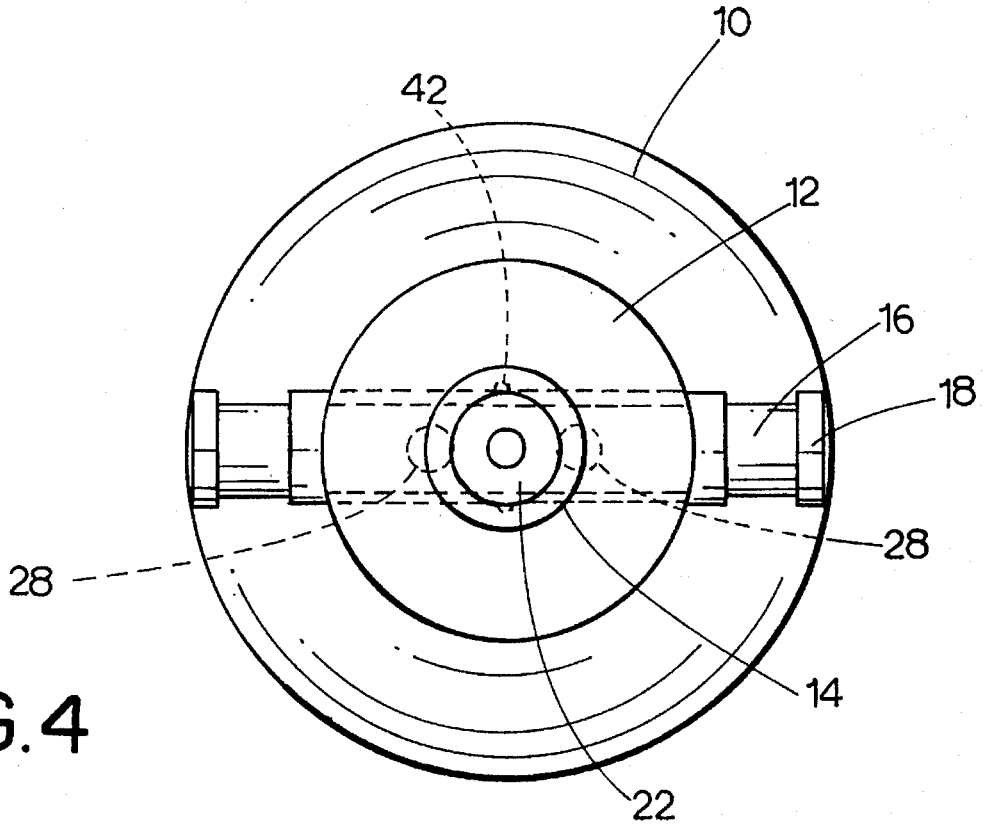
FIG. 4 is a top plan view of the invention.

As can be seen from FIGS. 2–4, these views, collectively, fully illustrate the principles of the present invention. Cap 12 is formed and configured to seal the bottle 10 at the neck 24 with a matching seal 26. The seal 26 defines an interior of cap 12 and virtually hermetically seals the bottle 10 about the neck 24. The seal 26 and the neck 24 are interconnected by any one of a number of conventional interlocks, such as mating threads or snap fits. The scope of the invention, satisfies the complete manufacture of a bottle 10 and cap 12 as a individual unit, and to provide a cap 12 that is universally mounted on any conventional bottle.

Cap 12 has a channel 32 defined therein. Both channel 32 and sliding member 16 are generally oval in shape. This shape reduces the overall height and physical construction of cap 12. The stops 20 define the ends of channel 32. The internal surface of seal 26 completely encloses the bottle 10. Centrally located above the neck 24, in the seal 26, is a single opening or orifice 30 for allowing the contents of bottle 10 to be dispensed. In order to selectively dispense the fluid contents, the orifice 30 communicates with the channel 32 of the valve system. Opposite the valve system and axially aligned with the orifice 30, is an inverted conical orifice 22 defined by the spout 14. The orifice 22 along with spout 14 communicates with the valve system for directing the dispensing of the fluids expelled from bottle 10. The valve system provides the selective opening and closing of the bottle for dispensing and containing fluids in the bottle 10.

Figure 5:
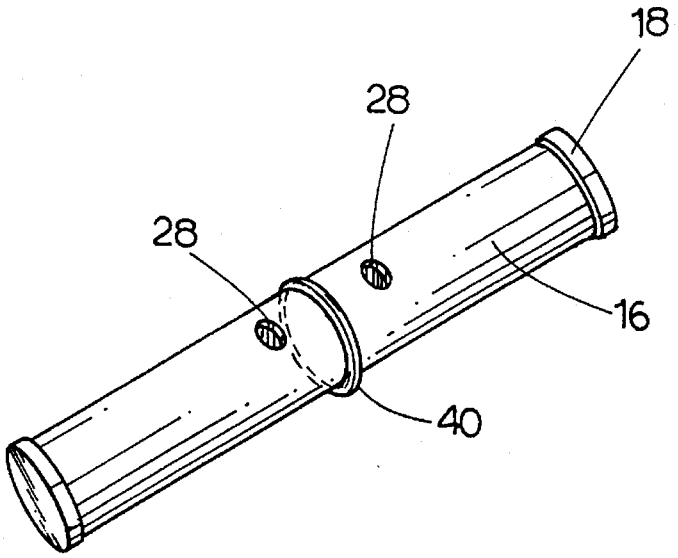
FIG. 5 is a perspective view of the sliding valve component of the valve system.

Centrally located in the channel 32 is a groove 42. Around the circumference and centrally located on the sliding member 16, is a raised rib 40 (see FIG. 5). The raised rib 40 and the groove 42 cooperate in providing an indirect tactile indication that the sliding member 16 is centrally located in the channel 32, the closed position of the valve system. On opposite sides of the rib 40, a pair of ports 28 are symmetrically defined in the sliding member 16. The ports 28 are positioned symmetrically such that when the sliding member 16 is pushed to either extreme, causing one of the stops 20 to engage the respective one of the flanges 18, one of the ports 28 would thereby be axially aligned with the orifice 30 and inverted conical orifice 22. This alignment defines one of the two opened positions of the valve system. In addition, the engagement of one of the stops 20 with the one of the flanges 18 provides a direct tactile indication that the valve is open.

This valve system allows the users to single handedly operate the valve without having to break his attention directed at other matters. For example: the bicyclist is able to maintain control of his or her bicycle with one hand, retrieve the water bottle from the frame cradle with his other hand, open the valve system, take a refreshing drink, close the valve system, return the bottle to the frame cradle, and resume two handed control of the bicycle without having to redirect attention from the course. The indirect tactile indication allows the rider to close the water bottle without fear of wasting precious water or time. Likewise, the direct tactile engagement of the stops and flanges allows the rider to positively consume the contents of the bottle without having to verify that the valve is open by eyesight, which also reduces wasted time and water.

It is to be understood that the present invention is not limited to the sole embodiment described above, but encompasses any and all embodiments within the scope of the following claims.

I claim:

1. In combination, a cap having a valve system, a spout, and a seal; and a fluid container for containing and dispensing fluid for single handed operation, said valve system comprising:

an oval shaped channel defined in and through said cap, said channel having a first stop and a second stop on each longitudinal end of said channel, and a groove centrally and circumferentially located in said channel;

an oval shaped sliding member located in the channel, having first and second ends, said first end having a first flange extending therefrom, and second end having a second flange extending therefrom, a raised rib centrally and circumferentially located thereon, and a first orifice and a second orifice, symmetrically positioned about said raised rib, formed in said sliding member;

a third orifice, centrally located in the bottom of said channel, communicating with said seal of said cap; and a fourth orifice, centrally located in the top of said channel, axially aligned with said third orifice, communicating with said spout of said cap;

said raised rib and said groove cooperatively providing an indirect tactile indicator of said valve system closure;

wherein, said valve system dispenses fluid by pushing said sliding member in said channel until one of said first flange or said second flange engages said first stop or said second stop, respectively, thereby aligning either of said first or second orifices with the third and fourth orifices allowing the fluid contained therein to pass therethrough.

2. The valve system according to claim 1, wherein said flanges protrude radially from the ends of the sliding member.

3. The valve system according to claim 1, wherein said fourth orifice is an inverted conical shape, defined within the spout.

4. A fluid containing and dispensing apparatus for use in bicycling, said apparatus comprising:

a body delimited by a wall defining a volume therein, having a neck extending therefrom; and a cap having a valve system, a spout, and a seal;

said seal coupled to said neck for producing a hermetical seal;

said spout for directing the flow of a fluid dispensed from said apparatus;

said valve system comprising an oval shaped channel defined in and through said cap, said channel having a first stop and a second stop on each longitudinal end of said channel, and a groove centrally and circumferentially located in said channel;

an oval shaped sliding member located in the channel, having first and second ends, said first end having a first flange extending therefrom, and second end having a second flange extending therefrom, a raised rib centrally and circumferentially located thereon, and a first orifice and a second orifice, symmetrically positioned about said raised rib, formed in said sliding member;

a third orifice, centrally located in the bottom of said channel, communicating with said seal of said cap; and a fourth orifice, centrally located in the top of said channel, axially aligned with said third orifice, communicating with said spout of said cap;

said raised rib and said groove cooperatively providing an indirect tactile indicator of said valve system closure, wherein, said valve system dispenses fluid by pushing said sliding member in said channel until one of said first flange or said second flange engages said first stop or said second stop, respectively, thereby aligning either of said first or second orifices with the third and fourth orifices allowing the fluid contained therein to pass therethrough.

* * * * *